US011849294B2

(12) United States Patent
Üstünberk et al.

(10) Patent No.: US 11,849,294 B2
(45) Date of Patent: Dec. 19, 2023

(54) HEADREST PROVIDED WITH A SYSTEM FOR TWO-WAY SOUND TRANSMISSION BY BONE CONDUCTION

(71) Applicant: MARTUR ITALY S.R.L., Milan (IT)

(72) Inventors: Can Üstünberk, Grugliasco (IT); Tiziano Serra, Grugliasco (IT); Marco Borri, Grugliasco (IT); Varol Korkmaz, Grugliasco (IT)

(73) Assignee: MARTUR ITALY S.R.L., Milan (IT)

( * ) Notice: Subject to any disclaimer, the term of this patent is extended or adjusted under 35 U.S.C. 154(b) by 0 days.

(21) Appl. No.: 17/776,025

(22) PCT Filed: Oct. 27, 2021

(86) PCT No.: PCT/IB2021/059929

§ 371 (c)(1),
(2) Date: May 11, 2022

(87) PCT Pub. No.: WO2022/090959

PCT Pub. Date: May 5, 2022

(65) Prior Publication Data

US 2022/0394386 A1 Dec. 8, 2022

(30) Foreign Application Priority Data

Nov. 2, 2020 (IT) ..... 102020000026092

(51) Int. Cl.
*H04R 5/02* (2006.01)

(52) U.S. Cl.
CPC ..... *H04R 5/023* (2013.01); *H04R 2460/13* (2013.01); *H04R 2499/13* (2013.01)

(58) Field of Classification Search
CPC ..... H04R 5/023; H04R 2460/13; H04R 2499/13; H04R 1/46
See application file for complete search history.

(56) References Cited

U.S. PATENT DOCUMENTS

| | | | | |
|---|---|---|---|---|
| 5,151,944 | A | 9/1992 | Yamamura | |
| 10,747,026 | B1 * | 8/2020 | Zhang | G02C 11/06 |
| 2020/0055434 | A1 * | 2/2020 | Hunt | B60N 2/809 |

FOREIGN PATENT DOCUMENTS

| | | | |
|---|---|---|---|
| CN | 110949219 | A | 4/2020 |
| CN | 111791775 | A | 10/2020 |
| GB | 2275149 | A | 8/1994 |
| JP | 2004-083004 | A | 3/2004 |
| JP | 2005-118248 | A | 5/2005 |

(Continued)

OTHER PUBLICATIONS

International Search Report and Written Opinion of the International Searching Authority issued for International PCT Application No. PCT/IB2021/059929 dated Jan. 31, 2022.

*Primary Examiner* — Brian Ensey
(74) *Attorney, Agent, or Firm* — HOWSON & HOWSON LLP

(57) ABSTRACT

A sound transmission system for a headrest has a bone conduction speaker and bone conduction microphone mounted on the same printed circuit board. Additional components of the bone conduction two-way sound transmission system, such as a control unit, contact sensors or proximity sensors, and an antenna for communication with external electronic devices can be mounted on the same printed circuit board.

17 Claims, 2 Drawing Sheets

(56) References Cited

FOREIGN PATENT DOCUMENTS

| | | | |
|---|---|---|---|
| JP | 2007-125071 | A | 5/2007 |
| JP | 2018-125829 | A | 8/2018 |
| KR | 101500217 | B1 | 3/2015 |
| KR | 2018-0128767 | A | 12/2018 |
| TW | M497393 | U | 3/2015 |

* cited by examiner

HEADREST PROVIDED WITH A SYSTEM FOR TWO-WAY SOUND TRANSMISSION BY BONE CONDUCTION

TECHNICAL FIELD

The present invention relates to a headrest provided with a system for two-way sound transmission by bone conduction.

The present invention can be applied, more particularly, in the manufacturing of headrests for vehicle seats, and, even more particularly, in the manufacturing of headrests for car seats.

BACKGROUND ART

Bone conduction is a well-known phenomenon by which sound is transmitted to the inner ear through the bones of the skull (instead of through the air).

The transmission of sound by bone conduction has several advantages, including the following ones:

- it does not block external sounds, thus keeping the user aware of the noises of the surrounding environment;
- it maintains sound clarity in noisy environments;
- it guarantees a high level of privacy, as the sounds are not diffused into the surrounding environment.

These advantages are particularly appreciable in closed environments with limited dimensions which can accommodate several people, such as the cockpits of vehicles, more particularly of cars.

For this reason, headrests for vehicle seats equipped with bone conduction two-way sound transmission systems have been developed in the recent past.

In the case of the driver's headrest, it is evident that the possibility of listening to music or having a telephone conversation without this interfering with the perception of the noises of the surrounding environment is a considerable advantage, as it allows—for example—to perceive the presence of an approaching emergency vehicle or to promptly avoid potentially dangerous situations.

More generally, headrests equipped with bone conduction sound transmission systems allow different occupants of the same vehicle to listen to different music without disturbing the other occupants, or to conduct telephone conversations with a certain degree of privacy.

By way of example, document JP 2018-125829 discloses a headrest for vehicle seats having a section which protrudes towards the occipital region of the occupant when the latter is in a normal sitting posture, and in which a seat suitable for accommodating a bone conduction loudspeaker is provided.

A headrest with a similar structure is also described in JP 2007-125071.

JP 2005-118248 relates to a headrest for vehicle seat comprising a bone conduction microphone and a bone conduction loudspeaker. One between the microphone and the speaker is installed in a portion of the headrest in contact with the cervical vertebrae of a person sitting on the seat, and the other one is installed in a portion of the headrest in contact with the skull of said person; the headrest is mounted to be orientable towards the person sitting on the seat, so that the bone conduction microphone and the bone conduction speaker can correctly come into contact with the respective anatomical parts of said person.

A headrest with a similar structure is also described in JP 2004-083004, wherein, however, only a portion of the headrest containing a bone conduction microphone and a bone conduction speaker is mounted pivotable towards the skull of the person occupying the seat.

Document CN 110949219 discloses a structure for a headrest for vehicle seat having a bone conduction sound transmission device and a traditional sound transmission device; the headrest further comprises a pressure sensor to detect contact between the skull of the person sitting on the seat and the headrest and a control unit to selectively activate/deactivate the bone conduction sound transmission device and the traditional sound transmission device.

Document KR 10-1500217 discloses a structure for a headrest for vehicle seat which comprises a first portion in which a bone conduction sound transmission device is received and a second portion which is mechanically deformable. The headrest further comprises a proximity sensor for detecting the position of the skull of the person sitting on the seat and means for deforming the mechanically deformable second portion of the headrest until it comes into contact with the skull of said person.

However, the solutions described in the afore-mentioned documents—and, more generally, the solutions available in the state of the art—are not free from drawbacks.

In detail, these solutions are either rough and not very efficient, or they are extremely complex.

In the case of simple but poorly efficient headrest structures, the two-way transmission of sound by bone conduction may be of poor quality or intermittent, or the use of the headrest can be extremely uncomfortable, if not annoying, due to excessive contact with the skull of the person occupying the seat.

In the case of sophisticated but complex headrest structures, this complexity may lead to a significant increase in manufacturing times and costs. Furthermore, in the case of bone conduction two-way sound transmission systems which, in order to achieve good performance, include a high number of components, in addition to the increase in assembling times of the headrest, the high risk of errors in positioning and connecting the different components to one another has to be considered.

In light of all the above, the main object of the present invention is to provide a headrest equipped with a bone conduction two-way sound transmission system which overcomes the limitations of prior art and combines a simple and reliable structure with high performance.

Another object of the present invention is to provide a headrest equipped with a bone conduction two-way sound transmission system which guarantees good quality sound conduction while ensuring high comfort for the user.

These and other objects are achieved by a headrest as claimed in the attached claims.

SUMMARY OF INVENTION

Thanks to the fact that one or more bone conduction loudspeakers and one or more bone conduction microphones are mounted on one and the same printed circuit board, the bone conduction two-way sound transmission system of the headrest according to the invention has a simple and compact structure.

Advantageously, assembling the different components of the bone conduction two-way sound transmission system—as well as any other additional components present on the printed circuit board—takes place in a different and separate step with respect to assembling of the headrest and it can be carried out in conditions favourable to achieve high reliability and precision. As a result, when assembling the headrest, a single component (namely the printed circuit board) has to be mounted in the headrest, with a drastic reduction in the risk of human errors in terms of correct positioning.

Furthermore, the possibility of arranging and connecting the different components of the bone conduction two-way sound transmission system—as well as any other additional components present on the printed circuit board—in a separate step allows to optimize and minimize the overall time and costs for manufacturing the headrest.

Moreover, assembling the different components of the bone conduction two-way sound transmission system on a same printed circuit board allows to reduce the overall number of electronic components and connections, which lead to a higher reliability as well as to reduced costs.

In addition, such compact structure of the sound transmission system according to the invention allows to minimize the overall size of the system itself, which allows to incorporate said sound transmission system into the headrest body in an easier way.

Besides the above-mentioned advantages relating to the manufacturing process, mounting both the bone conduction loudspeaker(s) and the bone conduction microphone(s) on the same printed circuit board also entails several advantages related to the bone conduction two-way sound transmission system.

More particularly, both the bone conduction loudspeaker(s) and the bone conduction microphone(s) will be arranged at the same, optimal position relative to the user's head and to the headrest.

In a preferred embodiment of the invention, the printed circuit board carrying the bone conduction loudspeaker(s) and the bone conduction microphone(s) is arranged in a portion of the headrest that, in use, is close to the occipital region of the user.

At this region, there are less human tissues through which the signal should travel in order to reach the user's inner ear, which will enhance the quality of sound transmission, both when speaking and when listening.

In addition, in general users have less hair at the occipital region than at the upper region of the head (parietal region). Since the presence of hair between the user's skull and the bone conduction loudspeaker(s) and microphone(s) may cause undesirable noise due to vibration generated by friction between the hair and the headrest, arranging both the bone conduction loudspeaker(s) and the bone conduction microphone(s) close to the occipital region of the user will improve the sound to noise ratio, thus enhancing the quality of the communication.

According to the invention, the bone conduction loudspeaker(s) and the bone conduction microphone(s) are mounted on the same printed circuit board at different locations.

This allows to provide a layer of sound absorbing material between said bone conduction loudspeaker(s) and said bone conduction microphone(s), thus avoiding interferences between input signals (incoming communications) and output signals (outgoing communications).

Advantageously, the bone conduction loudspeaker(s) and the bone conduction microphone(s) are mounted on the same printed circuit board in such a way that input signals and output signal travel through different skull bones. This helps in avoiding interferences and disturbances between incoming communications and outgoing communications.

The printed circuit board may be a rigid printed circuit board; however, in a preferred embodiment of the invention it is a flexible printed circuit board.

Using a flexible printed circuit board allows to avoid the risk of interferences and disturbances between input signals and output signals, since the flexibility of the printed circuit board itself inherently allows to damp undesired vibrations, thus suppressing possible interferences between bone conduction loudspeaker(s) and microphone(s).

By the way, the choice of a flexible printed circuit board is particularly advantageous at high sound power levels, due to the capability of reducing undesired vibration feelings.

The damping properties of a flexible printed circuit board also allow to reduce the mechanical stresses of the electronic components mounted thereto.

In addition, using a flexible printed circuit board allows to optimize the contact between the bone conduction loudspeaker(s) and microphone(s) and the user's head, as well, as to adapt the bone conduction sound transmission system of the invention to headrests having any shapes and designs.

Using a flexible printed circuit board also allows to enhance the thermal management of the sound transmission system, since heat is dissipated in a better way.

In a preferred embodiment of the invention, the printed circuit board that carries the bone conduction two-way sound transmission system is mounted in a portion of the headrest that is separated from the headrest main body and is movable relative to it.

According to this embodiment, said separate headrest portion can be brought from a rest position, in which it is far from the user's skull, to an operating position, in which it is in contact with it.

This possibility increases the user's comfort, namely in case the user is the driver of the vehicle, as he/she can maintain the posture that is most comfortable for him/her to drive without having to worry about keeping his/her head in contact with the headrest.

In this regard, it should be noted that experimental studies have shown that the efficiency of sound transmission is maximum in the case of contact with the occipital region of the user's skull (mainly for the reasons already set forth above).

In the case of traditional headrests, the portion of the skull that first comes into contact with the headrest is the parietal portion (unless the headrest is oriented in a totally uncomfortable way for the user). On the other hand, by mounting the bone conduction two-way sound transmission system in a headrest portion which is movable and adjustable, said portion can be arranged to come into contact with the occipital region of the user's skull.

In this embodiment, although it is possible for the user to manually move the movable headrest portion, the headrest will preferably be provided with proximity and/or contact sensors, and with actuators that drive the displacements of said movable portion, as well as with a control unit that sends command signals to said actuators according to the data detected by said proximity and/or contact sensor.

Advantageously, the sensors, the control unit, as well as the connections between said sensors and said control unit and the connections between said control unit and the actuators can be provided on the same printed circuit board that carries the bone conduction two-way sound transmission system.

Although the invention finds particular application in the field of motor vehicles ("automotive"), it is evident that the headrest according to the invention can equally be applied to the headrest of seats of other types of vehicles (means of public transport, trains, airplanes, etc.), as well as—more generally—to seats of other kinds and types.

BRIEF DESCRIPTION OF DRAWINGS

Further features and advantages of the invention will become more evident from the detailed description of a preferred embodiment, given by way of non-limiting example, with reference to the accompanying drawings, in which.

DESCRIPTION OF EMBODIMENTS

In the following description of a preferred embodiment of the invention, reference will be made to an application to a headrest for a motor vehicle seat.

It is understood that this application must not be understood in a limiting sense and several other applications to headrest for other types of seats can be envisaged.

Figure 1A:
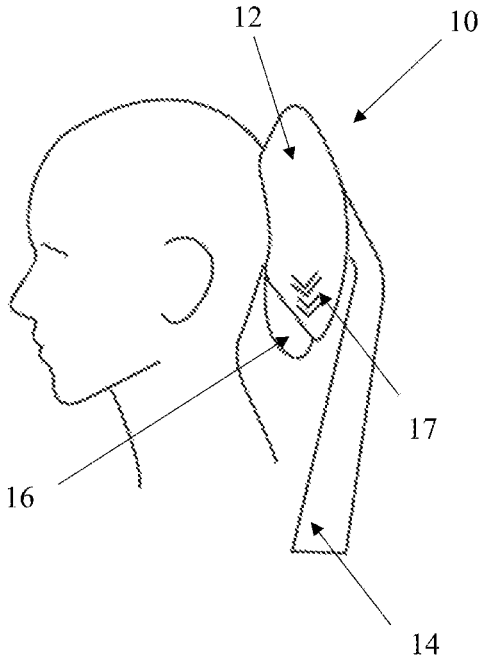
FIG. 1*a* schematically shows a headrest according to the invention, shown in a first working position.
Figure 1B:
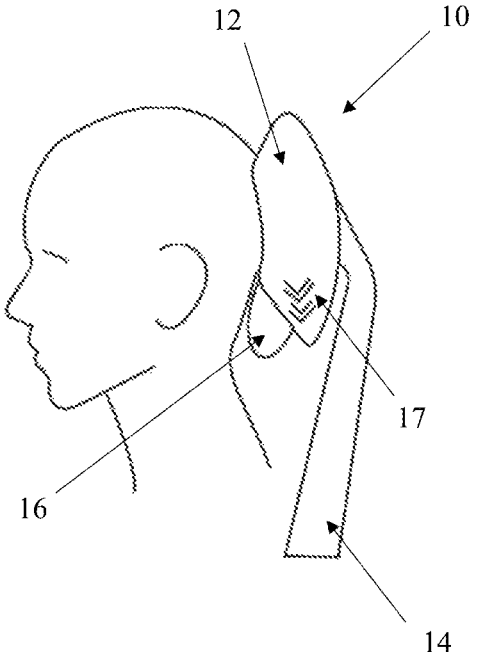
FIG. 1*b* schematically shows a headrest according to the invention, shown in a second working position.
Figure 1C:
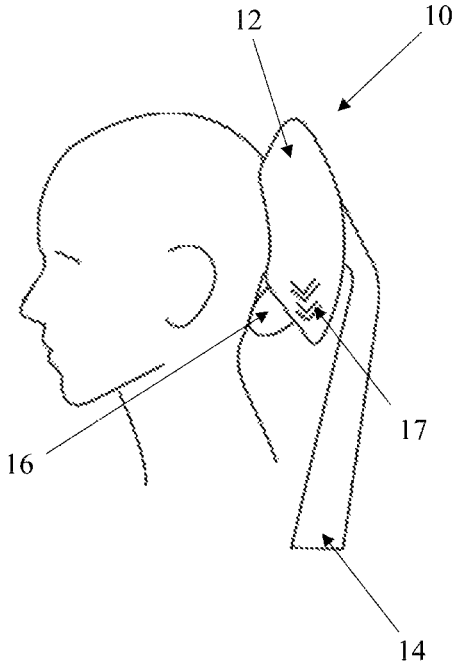
FIG. 1 *c* schematically shows a headrest according to the invention, shown in a third working position.

FIGS. 1*a*-1*c* schematically show a headrest 10 according to the invention.

In a per se known way, said headrest 10 comprises a main body 12 mounted on a single central body or on two rods 14 and connected through it/them to the backrest of the corresponding seat.

The main body 12 of the headrest 10 preferably has an anatomical shape and is mounted in an adjustable manner on the single central body or on the rods 14, so that its position can be adapted to the morphology of the user.

More particularly, the main body 12 of the headrest 10 can be adjustable in height and/or in orientation around a horizontal axis parallel to the seat backrest. For the reasons that will be clarified hereinafter, said main body is preferably adjustable at least in orientation about said horizontal axis parallel to the seat backrest.

According to the invention, the headrest 10 is equipped with a bone conduction two-way sound transmission system, which will be described in detail below.

In the preferred embodiment of the invention described and illustrated herein, said bone conduction two-way sound transmission system is mounted in a headrest portion 16 which is separated from the main body 12 of said headrest and is connected to said main body so as to be movable relative to it.

The headrest portion 16 carrying the bone conduction two-way sound transmission system is preferably arranged at the lower part of the main body 12 of the headrest, so that it can be brought into contact with the occipital region of the user's skull rather than with its parietal region.

Indeed, experimental tests have shown that the bone conduction two-way sound transmission is optimal when the contact occurs at the occipital region.

In a particularly simple embodiment of the invention, it is possible to provide that the headrest portion 16 is manually moved by the user to bring it into contact with his/her own skull.

However, in the preferred embodiment of the invention, the movement of said headrest portion 16 is obtained by means of suitably controlled actuators capable of obtaining translation and/or rotation movements of said headrest portion with respect to the main body of the headrest itself.

Thanks to these actuators—the operation of which will be described in greater detail below—the headrest portion 16 carrying the bone conduction two-way sound transmission system can be selectively brought from a rest position (see [FIG. 1*a*]), in which it is spaced away from the user's skull, to an operating position (see FIGS. 1*b* and 1*c*), in which it is in contact with the occipital region of the user's skull.

In this way, when the bone conduction two-way sound transmission system is not in use, the headrest portion 16 does not interfere with the comfort of the user, while when the bone conduction two-way sound transmission system is in use the correct contact with the user's skull is guaranteed.

The headrest portion 16 is preferably made of spongy material, even more preferably of shape memory foam. In this way, when said headrest portion comes into contact with the user's skull, it fits to the specific morphology of the user's skull, so as to increase the contact area with the skull itself and ensure optimal operation of the bone conduction devices.

In a particularly preferred embodiment of the invention, the front part of the headrest portion 16, facing the user's skull and intended to come into contact with it, is made of a spongy material, preferably a shape memory foam, while the rear part of the headrest portion 16, far from the user's skull, is made of sound-absorbing material. Thanks to this precaution, even if the bone conduction two-way sound transmission system is used at a very high volume, the sound will not be transmitted to the surrounding environment.

Figure 2:
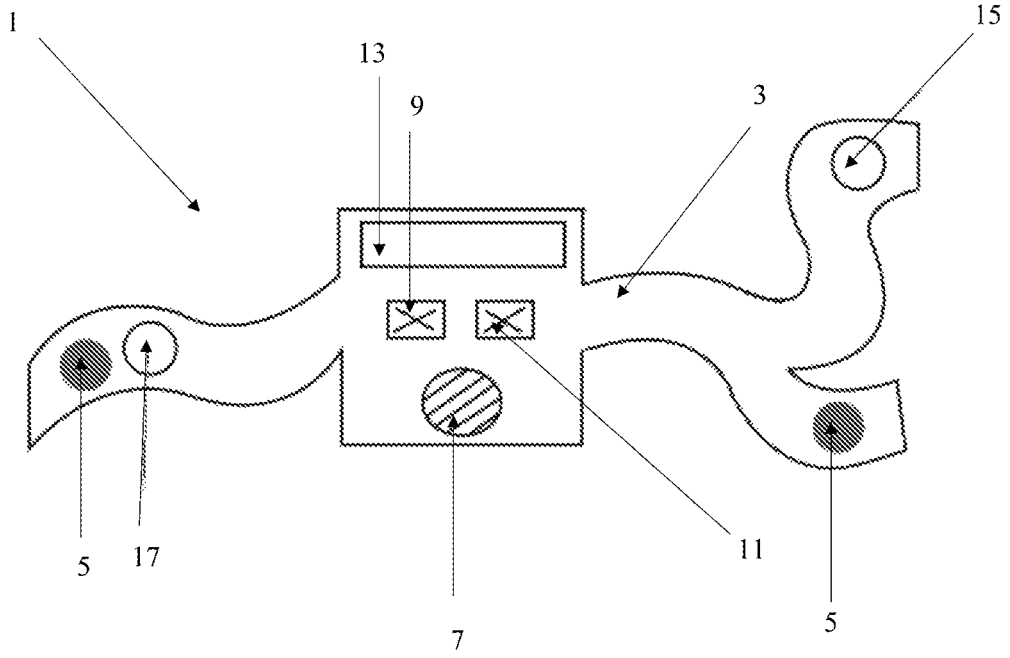
FIG. 2 schematically shows the bone conduction two-way sound transmission system of FIGS. 1*a*-1*c*.

The bone conduction two-way sound transmission system 1 of the headrest 10 according to the invention is schematically shown in [FIG. 2].

Said two-way sound transmission system 1 comprises at least one bone conduction speaker 5 and at least one bone conduction microphone 7 and, according to the invention, said at least one bone conduction loudspeaker 5 and said at least one bone conduction microphone 7 are positioned on one and the same printed circuit board 3.

The conduction loudspeaker 5 and the bone conduction microphone 7 are positioned on the printed circuit board 3 at different locations, so as to avoid undesired interferences and disturbances between input signals and output signals.

Preferable, a layer of sound adsorbing material is arranged between the conduction loudspeaker 5 and the bone conduction microphone 7, so that the risk of undesired interferences and disturbances between input signals and output signals is further reduced.

With respect to known solutions, providing a single printed circuit board that carries both the bone conduction speakers and the bone conduction microphones provides for flexibility in the design of the geometries and shapes of the headrest, ease of mounting the device in the seat headrest, reduction of assembly time and better quality in assembly (due to the reduction of human errors).

Although the printed circuit board 3 may be a rigid printed circuit board, it preferably is a flexible printed circuit board.

Using a flexible printed circuit board advantageously allows to adapt the conformation of the board itself in order to obtain the optimal positioning of the bone conduction devices in the headrest portion 16.

Moreover, in a flexible printed circuit board undesired vibrations are dampened thanks to the flexibility of the printed circuit board, which helps in preventing interferences and disturbances between input signals and output signals, and also reduces mechanical stresses on the components of the loudspeaker and microphone.

In any case, it cannot be excluded that the printed circuit board 3 is obtained by means of a combination of rigid parts and flexible parts.

[FIG. 2] shows a pair of bone conduction speakers 5, symmetrically arranged on the printed circuit board 3, and a bone conduction microphone 7. However, this configuration should not be construed as limiting and the bone conduction two-way sound transmission system 1 may comprise any desired number of bone conduction devices: the person skilled in the art will be able to identify a correct compromise between the efficiency of the two-way sound transmission and the complexity of the system.

On the face opposite to the face carrying the bone conduction devices 5, 7 (i.e. on the face furthest from the user), the printed circuit board 3 can then be advantageously coupled to a layer of sound-absorbing material, for example of plastic. This layer of sound-absorbing material allows to limit the speed of propagation of vibrations in the direction opposite to the user and thus to avoid sound losses related to the propagation of sound through the spongy material of the headrest portion 16 and of the headrest main body 12.

Thanks to this precaution, even if the bone conduction two-way sound transmission system is used at a very high volume, the sound will not be transmitted to the surrounding environment.

As shown in [FIG. 2], the printed circuit board 3 is also equipped with appropriate sensors capable of detecting contact with the user's skull and/or distance from the user's skull. In detail, the printed circuit board 3 may comprise:

- a pressure sensor 9, suitable for quantifying the contact pressure between the user's skull and the headrest 10 (or more precisely the headrest portion 16 in the shown embodiment);
- a proximity sensor 11, suitable for evaluating the distance between the user's skull and the headrest 10 (or more precisely the headrest portion 16 in the shown embodiment).

As mentioned above, the headrest portion 16 carrying two-way sound transmission system 1 is provided with actuators for driving the movement of said headrest portion according to the measurements of the pressure sensor 9 and of the proximity sensor 11.

Advantageously, in a preferred embodiment of the invention said actuators 15 can also be arranged on and/or connected to the same printed circuit board 3 that carries the bone conduction devices 5, 7, which further reduces the overall number of components of the two-way sound transmission system 1, with the advantages set forth above.

In detail, the data detected by the proximity sensor 11 allow to quantify how much the headrest portion 16 has to move to fill the gap separating it from the user's skull.

On the other hand, the data detected by the pressure sensor 9 are used to find a good compromise between the user's comfort and a large contact surface with the user's skull.

In embodiments of the invention in which the two-way sound transmission system 1 is not mounted in a headrest portion separate from the rest of the headrest body, the actuators will be configured to move the whole headrest.

In the illustrated embodiment, it is also possible to foresee the provision of first actuators for driving the movement of the headrest portion 16 and of second actuators for driving the movement of the main body 12 of the headrest 10. In this way, it will be possible to combine the movements of the main body 12 of the headrest 10 and those of the headrest portion 16 in order to optimally position the bone conduction two-way sound transmission system 1.

The pressure sensors and/or proximity sensors can be made according to any technology known to the person skilled in the art. Non-limiting examples of such technologies include capacitive sensors, ultrasonic sensors, piezoelectric sensors, radar sensors.

The actuators for operating the headrest portion and/or the main body of the headrest are preferably electro-mechanical actuators.

It is evident that the two-way sound transmission system 1 will also comprise a control unit 13 configured to send command signals to said actuators according to the data detected by the sensors 9, 11.

Advantageously, said control unit is also provided on the same printed circuit board 3 that carries the bone conduction devices 5, 7.

The connections between the control unit 13 and the sensors 9, 11 and the connections between the control unit 13 and the actuators 15 can also be provided on the same printed circuit board 3 that carries the bone conduction devices 5, 7.

Said printed circuit board 3 will also preferably be equipped with an antenna (not shown) which communicates and exchanges information with the on-board computer and/or with the vehicle hi-fi system and/or with the user's mobile phone through wireless communication protocols (for example Wi-Fi, Bluetooth, NFC).

Furthermore, it is not to be excluded that said printed circuit board 3 can interact with other electronic devices of the vehicle or of the user (tablet, multimedia file reader, etc.).

On the other hand, in order to avoid accidental interactions with such electronic devices, the control unit 13 can be arranged for switching on and off the sound transmission system.

Accordingly, when the sound transmission system is switched off, the risk of accidentally triggering a communication through such system is avoided, even if the user's is leaning his/her head against the headrest.

Switching on/off the sound transmission system can be implemented in several ways, for instance by a voice command. In this case, the risk of inadvertently switching on/off the sound transmission system while speaking should be avoided: this can be done by a special voice command, i.e. a special combination of words.

Furthermore, said printed circuit board 3 can optionally integrate LEDs 17 (also visible in FIGS. 1*a*-1*c*) which, if lit, indicate that the bone conduction two-way sound transmission system 1 is in use and/or that the bone conduction two-way sound transmission system 1 is switched on/off.

The bone conduction two-way sound transmission system 1—and in particular the control unit 13—can be connected to the vehicle battery and powered by it.

However, it is not to be excluded the possibility of using accumulators (capacitors, supercapacitors, etc.) to be integrated into the printed circuit board 3, which accumulators store energy that can be obtained from rigid/flexible solar cells arranged in areas of the headrest exposed to light.

From the above description it will be evident to the person skilled in the art that integrating a printed circuit board equipped with bone conduction speakers and microphones in the headrest or in a portion thereof allows to obtain considerable advantages, as the user can:

- listen to sounds or music to his/her liking, without however becoming estranged from the surrounding environment and disturbing the other occupants of the vehicle (or other passengers in the case of applications to vehicles for public transport service);
- listen to warning/danger signals related to events that may occur both inside and outside the vehicle (in this regard it is possible to provide that the control unit is able to assign a priority order to the transmitted sounds, assigning the highest priority level to said warning/danger signals);

have private telephone conversations, without the other occupants of the vehicle being able to hear and/or interact in the telephone call.

It will also be evident to the person skilled in the art that the above description has been given only by way of non-limiting example and that several variants and modifications are possible, without departing from the scope of protection defined by the attached claims.

In particular, the invention may be applied both to headrests for car seats, and to headrests for seats of other types of vehicles (trains, buses, airplanes, etc.).

The invention claimed is:

1. A headrest for vehicle seats, comprising a bone conduction two-way sound transmission system, which in turn comprises at least one bone conduction loudspeaker and at least one bone conduction microphone, wherein the at least one bone conduction speaker and the at least one bone conduction microphone are arranged on a same printed circuit board.

2. The headrest according to claim 1, wherein the printed circuit board is a flexible printed circuit board.

3. The headrest according to claim 1, wherein the at least one bone conduction speaker and the at least one bone conduction microphone are arranged at different locations on the same printed circuit board, at least one layer of sound absorbing material being provided between the at least one bone conduction speaker and the at least one bone conduction microphone.

4. The headrest according to claim 1, wherein the printed circuit board has a first face and a second, opposite face, wherein the at least one bone conduction speaker and the at least one bone conduction microphone are arranged on the first face of the printed circuit board, and wherein the second, opposite face of the printed circuit board is coupled to a layer made of sound-absorbing material.

5. The headrest according to claim 1, wherein the bone conduction two-way sound transmission system comprises one or more contact pressure sensors, and wherein the contact pressure sensors are arranged on the printed circuit board.

6. The headrest according to claim 5, wherein the bone conduction two-way sound transmission system comprises a control unit, which receives the measurements from the one or more contact pressure sensors, and wherein the control unit is arranged on the printed circuit board.

7. The headrest according to claim 6, wherein the bone conduction two-way sound transmission system is provided with actuators, which actuators receive control signals from the control unit in order to modify the position of the bone conduction two-way sound transmission system according to the measurements of the one or more contact pressure sensors, and wherein the actuators are mounted on the printed circuit board.

8. The headrest according to claim 1, wherein the bone conduction two-way sound transmission system comprises an antenna for communication with electronic devices external to the headrest via wireless communication protocols, and wherein the antenna is arranged on said printed circuit board.

9. The headrest according to claim 1, wherein the headrest comprises a main body and a headrest portion, which is made as a piece separate from the main body, is connected to the main body, and is movable relative to the main body, and wherein the bone conduction two-way sound transmission system is received in the headrest portion.

10. The headrest according to claim 9, wherein the main body has an upper part and a lower part, and wherein the headrest portion is arranged at the lower part of the main body of the headrest.

11. The headrest according to claim 9, wherein the headrest portion is made of a spongy material.

12. The headrest according to claim 9, wherein the headrest portion is made of shape memory foam.

13. The headrest according to claim 6, wherein the bone conduction two-way sound transmission system is provided with actuators, which actuators receive control signals from the control unit in order to modify the position of the bone conduction two-way sound transmission system according to the measurements of the one or more contact pressure sensors, and wherein the actuators are connected to the printed circuit board.

14. The headrest according to claim 1, wherein the bone conduction two-way sound transmission system comprises one or more proximity sensors, and wherein the one or more proximity sensors are arranged on the printed circuit board.

15. The headrest according to claim 14, wherein the bone conduction two-way sound transmission system comprises a control unit, which receives the measurements from the one or more pressure proximity sensors, and wherein the control unit is arranged on the printed circuit board.

16. The headrest according to claim 15, wherein the bone conduction two-way sound transmission system is provided with actuators, which actuators receive control signals from the control unit in order to modify the position of the bone conduction two-way sound transmission system according to the measurements of the one or more proximity sensors, and wherein the actuators are mounted on the printed circuit board.

17. The headrest according to claim 15, wherein the bone conduction two-way sound transmission system is provided with actuators, which actuators receive control signals from the control unit in order to modify the position of the bone conduction two-way sound transmission system according to the measurements of the one or more proximity sensors, and wherein the actuators are connected to the printed circuit board.

* * * * *